United States Patent [19]

Morris

[11] Patent Number: 4,926,975

[45] Date of Patent: May 22, 1990

[54] ELEVATOR CAR WITH IMPROVED DOOR LOCK

[75] Inventor: Arnold M. Morris, Chester Township, Morris County, N.J.

[73] Assignee: Inventio AG, Hergiswil, Switzerland

[21] Appl. No.: 309,630

[22] Filed: Feb. 13, 1989

[51] Int. Cl.[5] ..... B66B 13/00

[52] U.S. Cl. ..... 187/57; 187/61; 49/120

[58] Field of Search ..... 187/52 LC, 52 R, 57, 187/61, 51; 49/116, 120, 122

[56] References Cited

U.S. PATENT DOCUMENTS

| | | | |
|---|---|---|---|
| 1,326,440 | 12/1919 | Chaudoir | 187/52 LC |
| 1,838,524 | 12/1931 | Brown | 187/61 |
| 2,458,702 | 1/1949 | Hains | 187/52 LC |
| 2,816,625 | 12/1957 | McCormick | 187/52 LC |
| 3,605,952 | 9/1971 | Lusti | 187/52 LC |
| 3,659,677 | 5/1972 | Shalders | 187/61 |
| 3,721,319 | 3/1973 | Hall et al. | 187/61 |
| 4,313,525 | 2/1982 | McDonald | 187/57 |
| 4,357,998 | 11/1982 | Gibson et al. | 187/49 |
| 4,364,454 | 12/1982 | Glaser et al. | 187/57 |
| 4,423,799 | 1/1984 | Glaser et al. | 187/57 |
| 4,436,184 | 3/1984 | Dorman et al. | 187/29 R |
| 4,469,200 | 9/1984 | Young et al. | 187/61 |
| 4,491,200 | 1/1985 | Thompson et al. | 187/61 |
| 4,512,443 | 4/1985 | Dewhurst | 187/57 |
| 4,529,065 | 7/1985 | Kraft | 187/57 |

FOREIGN PATENT DOCUMENTS

| | | |
|---|---|---|
| 468376 | 7/1937 | United Kingdom . |
| 1047977 | 11/1966 | United Kingdom . |

*Primary Examiner*—Joseph J. Rolla
*Assistant Examiner*—Kenneth Noland
*Attorney, Agent, or Firm*—D. R. Lackey

[57] ABSTRACT

An elevator car having a clutch carried by a car door for engaging drive rollers of an adjacent hatch door via "open" and "close" vanes of the clutch. A door operator mounted on the car includes a door drive arm which is linked to the car door via a door crank arm. A door lock carried by the door clutch prevents normal operation of the door crank arm, unless the open vane of the door clutch contacts a hatch door drive roller. Thus, unless the car is in a floor landing zone, the car door cannot be opened by a passenger inside the car.

3 Claims, 3 Drawing Sheets

ELEVATOR CAR WITH IMPROVED DOOR LOCK

TECHNICAL FIELD

The invention relates to an elevator car having a door which is opened and closed at the floors of a building the elevator car is serving, and more specifically to a door lock for preventing the elevator car door from being opened by a passenger unless the car is within a predetermined landing zone relative to a floor.

BACKGROUND ART

An elevator car door is driven between open and closed positions relative to an entrance to a cab by a door operator mounted on top of the cab. The cab, door operator, and a cab support or sling are collectively referred to as an elevator car. The hatch door at each floor of a building an elevator car is serving is unlocked by the presence of the car at the associated floor, and a clutch carried by the car door has "open" and "close" vanes which engage hatch door drive rollers to respectively open and close the hatch door in unison with the car door.

The elevator car door must be prevented from being opened by a passenger in the cab, unless the elevator car is close enough to a floor to enable safe egress. There are many different arrangements for accomplishing a car door locking function, but in general they are complicated mechanically and/or costly to implement, with most locking the car door to some fixed point on the elevator cab adjacent to the car door entrance. It would be desirable, and is an object of the invention, to provide a new and improved elevator car door lock which is simple mechanically, has a low manufacturing cost, easy to add to an elevator car, and which operates without objectionable noise.

DISCLOSURE OF THE INVENTION

Briefly, the present invention is an elevator car having an improved car door lock which locks the car door without the necessity of providing a separate latch which runs from the car door clutch to a fixed point on the cab or entrance thereto. The door lock function is provided by adding only a few simple parts to the door clutch which lock up the door crank arm unless the door clutch is adjacent to a hatch door drive block roller. The locking mechanism operates with little noise because of very little mass in the operating parts, the parts are simple, readily available mechanical shapes requiring little processing, and they are easy to install and adjust as the parts are mounted entirely on the door clutch which is at eye level with plenty of light and accessibility.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
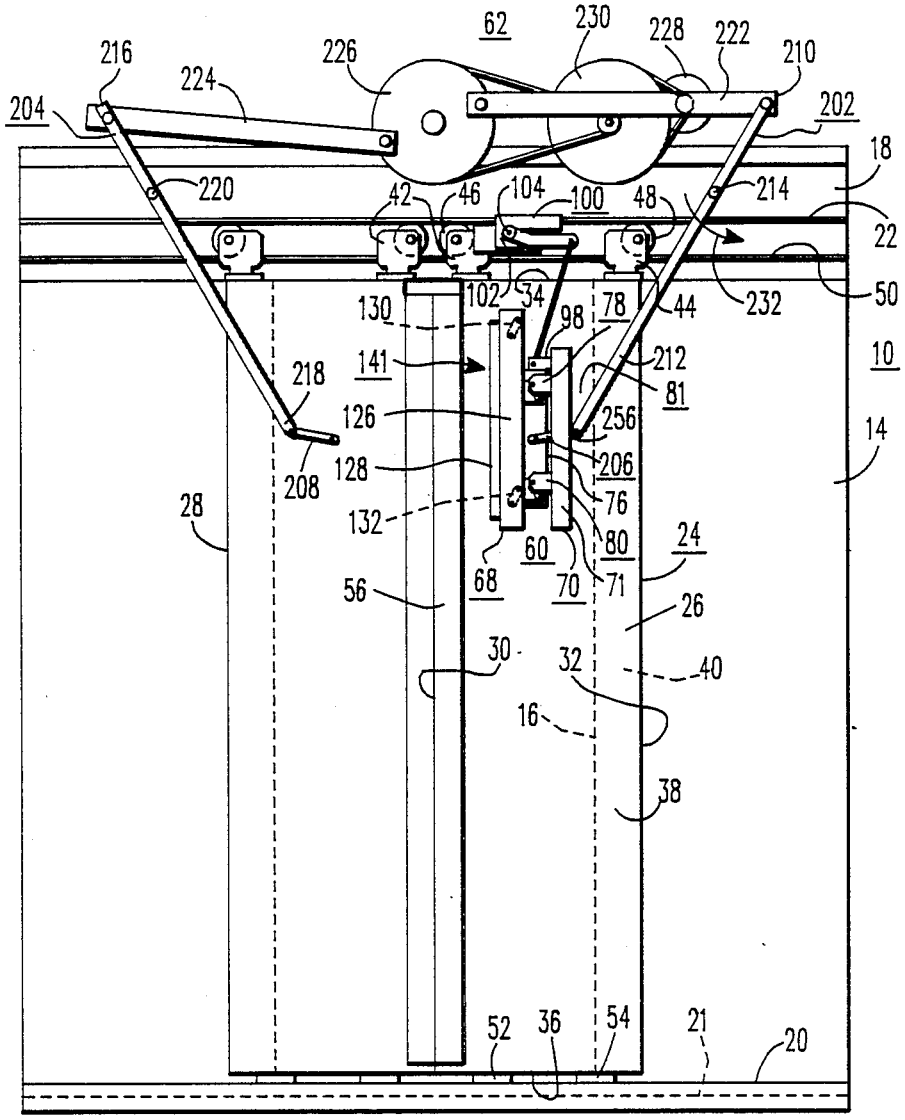
FIG. 1 is an elevational view of an elevator car which includes a cab, door clutch and door operator of the type which may utilize the teachings of the invention.

Referring now to the drawings, and to FIG. 1 in particular, there is shown a front elevational view of an elevator car 10 as it appears from the hatchway door side. A hatchway door is not shown in FIG. 1, but a hatchway door 12 is shown in a fragmentary right hand elevational view in FIG. 3.

Elevator car 10 includes a cab 14 which may be of conventional construction, having an opening 16 which is shown closed in FIG. 1. Cab 14 includes a header 18 disposed above opening 16, a door sill 20 disposed below opening 16, and a hanger roller track 22 fixed to header 18 above opening 16. Car 10 includes a car door 24 having one or more door panels, with a center opening door 24 having first and second panels 26 and 28 being shown for purposes of example. Door panel 26 includes vertically oriented leading and trailing edges 30 and 32, respectively, horizontally oriented upper and lower edges 34 and 36, respectively, and outer and inner flat major surfaces 38 and 40, respectively, disposed invertically oriented planes. Hangers 42 and 44, or functional equivalents thereof, are fixed to the upper edge 34 or door panel 26, with hangers 42 and 44 including hanger rollers 46 and 48, respectively, which are supported by a lip 50 of hanger roller track 2. Gibs, such as gibs 52 and 54, are attached to the lower edge of door panel 26, which extend into a continuous longitudinally extending groove 21 in door sill 20. A retractable object detecting edge 56 may be suitably attached to the leading edge 30 of door panel 26. Door panel 28 is similar to door panel 26 up to this point, and will not be described in detail.

A door clutch having a door lock constructed according to the teachings of the invention is fixed to one of the door panesl 26 or 28. For purposes of example, a left-hand clutch 60 is shown fixed to door panel 26, but a right-hand clutch could be alternatively attached to door panel 28, as desired. A right-hand clutch is a mirror image of left-hand clutch 60, and thus need not be described in detail. For purposes of example, a door clutch 60, except for the door lock which is constructed according to the present invention, is the door clutch shown and described in detail in concurrently filed application Ser. No. 07/309,629, entitled "Elevator Car With Improved Car Door Clutch" which is assigned to the same assignee as the presenta application. This concurrently filed application is hereby incorporated in the specification of the present application by reference, and thus only the portion of clutch 60 necessary to understand the door lock function will be described in detail.

The primary functon of door clutch 60 is to engage elements of hatch door 12 such that when a door operator 62 is linked to car door 24 it will drive panels 24 and 26 with a horizontal rectilinear motion to open and close car door 24. An adjacent hatch door 12 is driven simultaneously, in unison with car door 24. Each hatch door 12 in a building served by elevator car 10 includes a pair of horizontally spaced elements which are engaged by clutch 60, and for purposes of example they will be called hatch door drive block rollers, or simply drive rollers. First and second hatch door drive rollers 64 and 66 are shown in phantom in FIG. 2, and drive roller 66 is shown in solid in FIG. 3.

Door clutch 60 includes first and second vane assemblies 68 and 70, with the first vane assembly 68 being referred to as the "open" vane because it engages hatch door drive roller 66 to open hatch dor 12 when the car door 24 is being opened. The second vane assembly 70 is referred to as the "close" vane because it engages hatch door drive roller 64 to close hatch door 12 when the car door 24 is being closed.

Door clutch 60 includes a support base 76, and the close vane assembly 70, which includes a close vane 71, derives its support from base 76 via upper and lower linkage arrangements 78 and 80, respectively, which define a parallelogram linkage assembly 81. The upper linkage arrangement 78 includes a support arm 82 mechanically related to base 76, a vane support arm 84 fixed to close vane 71, and a pivot arm 86 pivotally interconnecting support arms 82 and 84 via pivot axes 83 and 85. The lower linkage arrangement 80 is of like construction.

Figure 2:
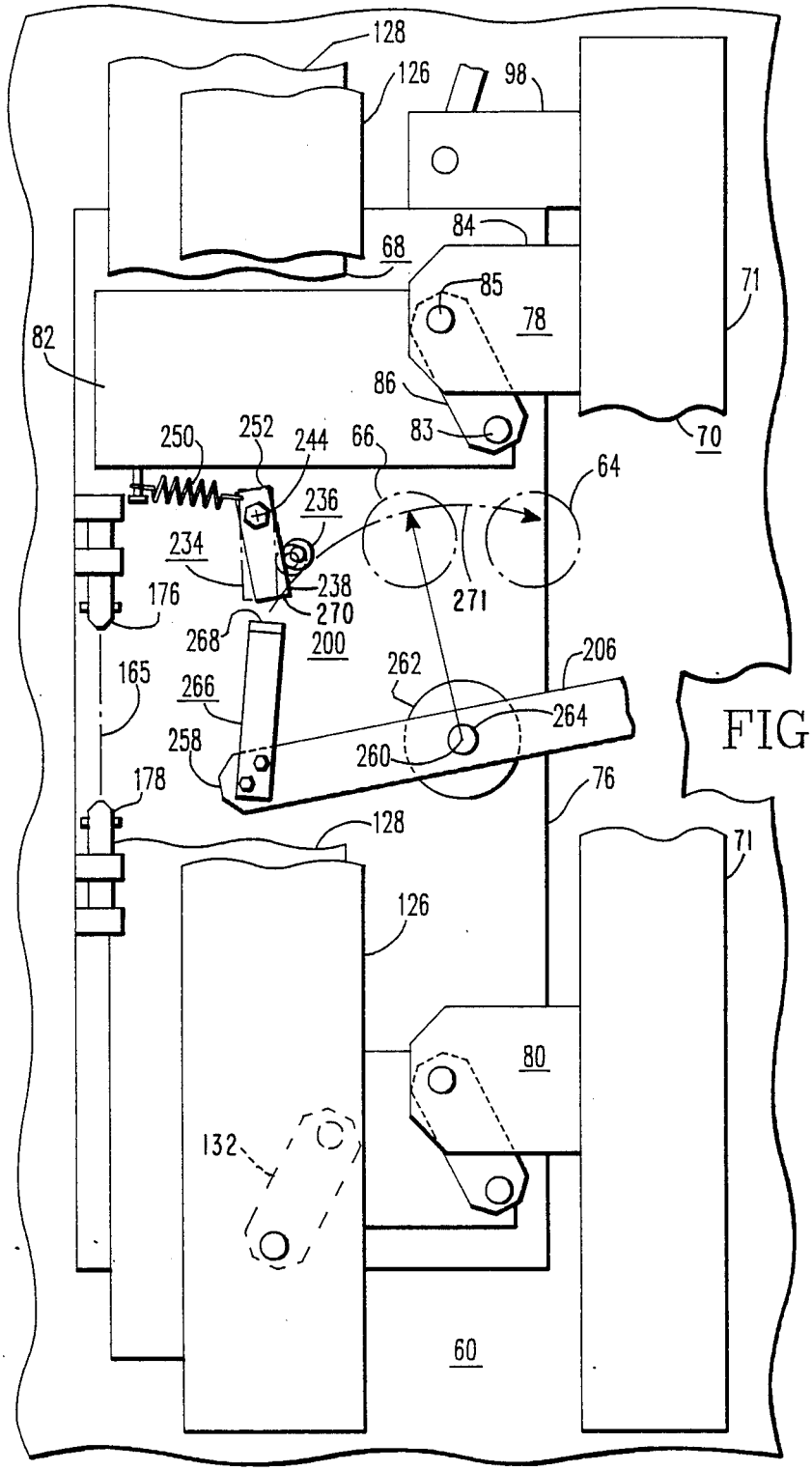
FIG. 2 is an enlarged, fragmentary front elevational view of the door clutch shown in FIG. 1, with parts cut away, illustrating a door lock constructed according to the teachings of the invention.

An operating or connecting bracket 98 is fixed to the upper end of close vane 71. The process of lifting operating bracketa 98 pivots or swings close vane 71 upwardly and to the right, as illustrated in FIGS. 1 and 2, to create a running clearance between vane assemblies 68 and 70 of clutch 60 and the hatch door rollers at the various floors. The process of lowering operating bracket 98 allows close vane 71 to swing downwardly to the left, by gravity, to eliminate the running clearance when car 10 stops at a floor and starts to open car door 24.

The mechanical lifting and lowering process which results in the swinging of the close vane assembly 70 between the running clearance and operative positions is directly responsive to the position of the elevator car door via a cam and cam follower arrangement 100 which includes a cam 102 fixed to hanger roller track 22 and a cam follower assembly 104 fixed to hanger 42 of door panel 26.

A door lock 200 is provided for car door 24 which is operated by door clutch 60. Door clutch actuation is provided for door lock 200 by constructing the open vane assembly 68 to provide a predetermined mechanical movement which unlocks door 24 when the open vane assembly 68 provides an opening force against hatch door roller 66. If door 24 is moved by a passenger when the open vane assembly 68 is not adjacent to a hatch door roller 66, then the mechanical door unlocking movement is not provided, maintaining the door 24 locked.

Open vane assembly 68 includes an open vane 126, which is movable to provide the door unlocking mechanical movement required, an open vane support plate 128, with open vane 126 being movable relative to this support plate, and upper and lower pivot arms 130 and 132 which pivotally link open vane 126 with its support plate 128. Thus, a parallelogram linkage arrangement 141 is provided for the open vane assembly 68 in which a force applied to the open vane 126 by hatch door roller 66 causes vane 126 to swing to the left when viewed in FIGS. 1 and 2.

As shown in FIG. 2, the open and close vane assemblies 68 and 70 of clutch 60 are pivotally attached to clutch base 76 via pivot pins 176 and 178 which have a common pivot axis 165. This feature is not essential to the door lock 200 and thus will not be described in detail.

Door operator 62 operates door panels 26 and 28 via door drive arms 202 and 204 and door crank arms 206 and 208. Door drive arm 202 includes first and second ends 210 and 212, respectively, and it is pivotally attached to header 18 intermediate its ends via a pivot pin 214. Door drive arm 204 includes first and second ends 216 and 218, respectively, and it is pivotally attached to header 18 intermediate its ends via a pivot pin 220. Door crank arms 206 and 208 are pivotally attached to door panels 26 and 28, respectively, and they are also pivotally attached to door drive arms 202 and 204, respectively. Door operator 62 is linked to the first ends 210 and 216 of drive arms 202 and 204, respectively, such as by mechanical links 222 and 224 which have one end pivotally fixed to the first ends of the door drive arms and an end fixed to a sheave or pulley 226 drivine by an electric motor 228 via a speed change pulley arrangement 230. Rotation of sheave 226 counterclockwise pulls link 222 to the left which results in door drive arm 214 swinging counterclockwise about pivot pin 214, as indicated by arrow 232, and door crank arm 206 pivots clockwise. This action applies an opening force to door panel 26. Counterclockwise rotation of sheave 226 pulls link 224 to the right, door drive arm 204 swings clockwise about pivot pin 220, and door crank arm 208 pivots counterclockwise. This action applies an opening force to door panel 28. Door lock 200 locks up the door drive linkage members between door panel 26 and door operator 62, preventing a force applied to either or both of the door panels by a passenger inside cab 14 from operating the linkages if hatch door roller 66 is not adjacent to the open vane 126 of clutch 60.

Figure 3:
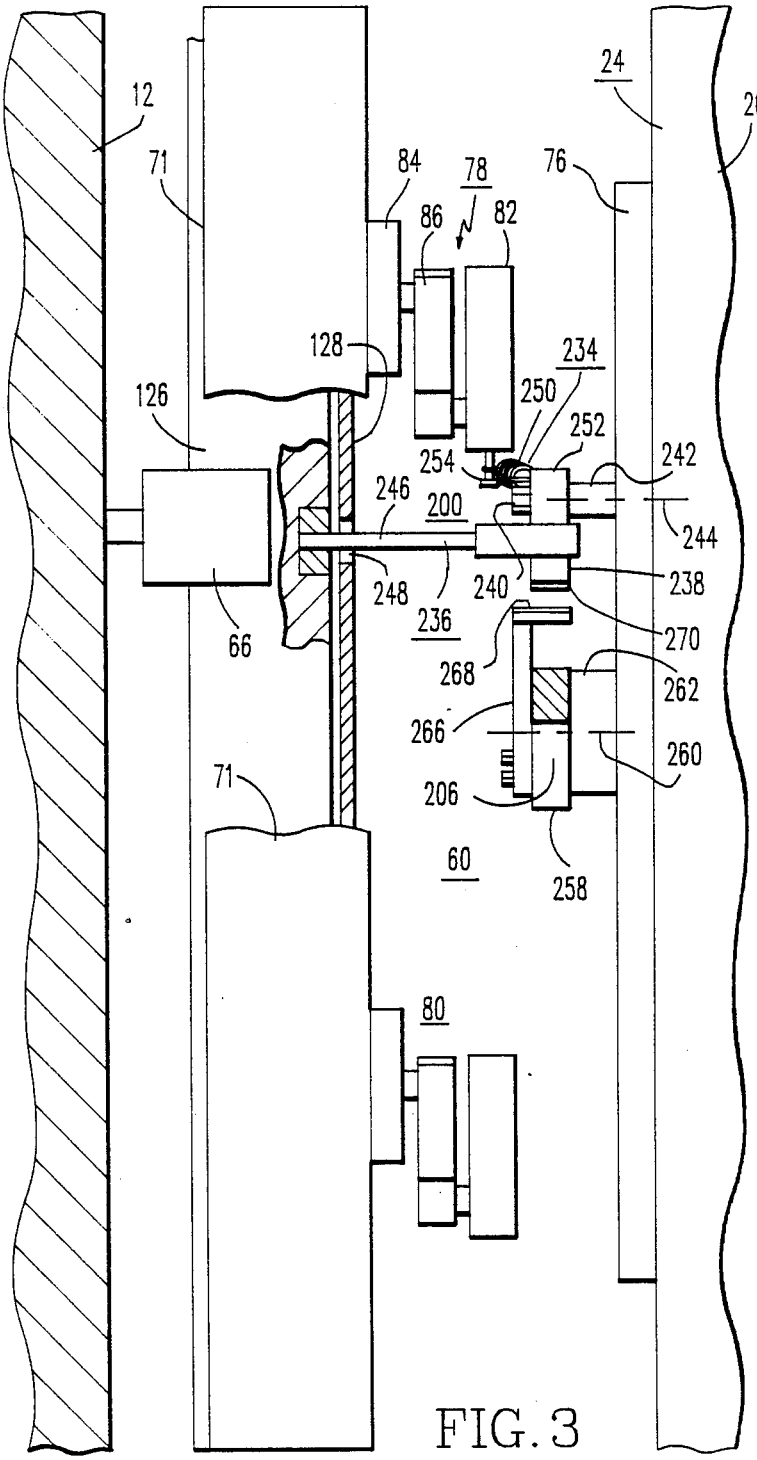
FIG. 3 is a side elevational view of the door clutch and door lock shown in FIG. 2.

As shown in FIGS. 2 and 3, door lock 200 includes first means 234 biased to a first position which prevents door crank arm 206 from moving beyond a predetermined dimension when the car door 24 is closed, with the predetermined dimension being selected to limit opening of the car door 24 such that passenger egress is prevented when the first means 234 is in said first position. Door lock 200 further includes second means 236 responsive to the open vane 126 contacting hatch door drive roller 66 for moving the first means to a second position which allows the car door 24 to be fully opened.

More specifically, the first means 234 includes a lever 238 which is pivotally fixed to clutch base 76 via a pivot pin 240. Pivot pin 240 may be a bolt spaced from base 76 via a spacer 242 with a clearance which enables lever 238 to pivot freely about pivot axis 244.

The second means 236 includes a post 246 fixed to the side of the movable open vane 126 which is adjacent to support plate 128. Post 246 extends through an opening 248 in support plate 128, with opening 248 being large enough that movement of post 246 with vane 126 will not be interfered with. Post 246 extends towards base 76 for a dimension sufficient to lie in the path of lever 238. A tension spring 250 extends between an end 252 of lever 238 and a convenient fixed point, such as to a pin 254 fixed to arm 82 of the close vane assembly 70. End 252 is chosen such that lever 238 is biased counterclockwise about pivot axis 244, causing lever 238 to press against post 246. The door locking first positions of lever 238 and post 246 are shown in solid and the door unlocking positions are shown in phantom.

Door crank arm 206 is modified such that in addition to an end 256 which is pivotally linked to door drive arm 202, it has an end 258 which extends past a pivot axis 260. Door crank arm 206 is spaced rom clutch base 76 by a spacer 262, and it is pivotally mounted to spacer 262 via a pivot pin 264. Pivot axis 260 is thus intermediate ends 256 and 258, and when crank arm 206 wings clockwise as door 24 is opened, end 258 follows a clockwise arc. A member 266 is fixed to end 58 of door crank arm 206, with member 266 being dimensioned and oriented towards lever 238. An outwardly extending end 268 or member 266 is spaced from an end 270 of lever 238 by a predetermined dimension. The predetermined dimension is selected to permit a passenger inside cab 14 to open the car door 24 a few inches for ventilation when car 10 is stopped more than a safe distance from a floor, and then end 268 of member 266 will contact end 270 of lever 238, locking up the linkage and preventing further opening of car door 24.

When car 10 stops within a predetermined dimension from a floor, such as ±11 inches, for example, opening car door 24 in response to door operator 62, or by a passenger in cab 14, will cause the movalbe vane 126 of open vane assembly 68 to contact hatch door roller 66, swinging the movable vane 126 to the left. Post 246 moves with vane 126, forcing lever 238 clockwise about its pivot axis 244 and out of the way of a movement arc or path 271 followed by member 266. Thus, door crank arm 206 may move freely, allowing car door 24 to open.

In summary, door lock 200 is easy to manufacture, install and adjust, requiring only a few simple parts which operate wit little or no noise. They cooperate to lock the car door 24 when the car is out of a landing zone, and the lock is automatically defeated when the car door is opened within a landing zone.

I claim:

1. An elevator car having a cab which defines an opening; a car door mounted for movement relative to the cab opening, between open and closed positions; a car door clutch carried by the car door having spaced open and close vanes for engaging hatch door drive rollers for simultaneously opening and closing a hatch door with the car door; a door operator having a door drive arm; and a door crank arm linking the door drive arm with the car door, the improvement comprising:

first means biased to a first position which prevents the door crank arm from moving beyond a predetermined dimension when the car door is closed, with the predetermined dimension being selected to limit car door opening such that passenger egress from the cab is prevented, and second means responsive to he open vane contacting a hatch door drive roller for moving the first means to a second position which allows the car door to be fully opened, with said open vane including a movable member responsive to engagement of the open vane with a hatch door roller, and wherein the second means includes a post member fixed to the movable member of the open vane, with said post member being positioned to move the first means to the second position when the movable member of the open vane is moved by engagement of the open vane with a hatch door roller.

2. An elevator car having a cab which defines an opening; a car door mounted for movement relative to the cab oening, between open and closed positions; a car door clutch carried by the car door having spaced open and close vanes for engaging hatch door drive rollers for simultaneously opening and closing a hatch door with the car door; a door operator having a door drive arm; and a door crank arm linking the door drive arm with the car door, the improvement comprising:

first means biased to a first position which prevents the door crank arm from moving beyond a predetermined dimension when the car door is closed, with the predetermined dimension being selected to limit car door opening such that passenger egress from the cab is prevented, and second means responsive to the open vane contacting a hatch door drive roller for moving the first means to a second position which allows the car door to be fully opened, wherein the door crank arm has first and second ends, and is pivotally fixed to the door clutch intermediate said ends, with the first end being connected to the door drive arm of the door operator and with the second end being adapted to contact the first means when the first means is biased to he first position.

3. The elevator car of claim 2 wherein the second end of the door crank arm includes a member fixed thereto and positioned to contact the first means when the first means is biased to the first position.

* * * * *